US009464416B1

(12) United States Patent
Breda

(10) Patent No.: US 9,464,416 B1
(45) Date of Patent: Oct. 11, 2016

(54) UNIBODY THERMOSTATIC RIM OR DECK MOUNT FAUCET ASSEMBLY

(71) Applicant: Silvano Breda, Toronto (CA)

(72) Inventor: Silvano Breda, Toronto (CA)

( * ) Notice: Subject to any disclaimer, the term of this patent is extended or adjusted under 35 U.S.C. 154(b) by 8 days.

(21) Appl. No.: 14/694,071

(22) Filed: Apr. 23, 2015

(51) Int. Cl.
*E03C 1/04* (2006.01)
*E03C 1/044* (2006.01)

(52) U.S. Cl.
CPC ..... *E03C 1/0404* (2013.01); *E03C 1/044* (2013.01)

(58) Field of Classification Search
CPC ..... E03C 1/04
USPC ..... 4/676
See application file for complete search history.

(56) References Cited

U.S. PATENT DOCUMENTS 4,980,933 A * 1/1991 Tsutsui ..... E03D 9/08 4/420.2
5,970,534 A * 10/1999 Breda ..... E03C 1/023 137/218
7,191,954 B2 * 3/2007 Kline ..... G05D 23/134 236/12.2
7,269,864 B2 9/2007 Brown et al.
7,775,450 B2 8/2010 Warshawsky

* cited by examiner

*Primary Examiner* — Huyen Le
(74) *Attorney, Agent, or Firm* — Nasser Ashgriz; UIPatent Inc.

(57) ABSTRACT

A deck or bath tub mounted unibody safety faucet comprising of a housing with a first chamber and a second chamber being at two ends of a longitudinal first water passageway, the chambers oriented perpendicular to the first water passageway; the first chamber receiving a thermostatic cartridge and the second chamber receiving a diverting flow cartridge; a first securing means to align and secure said thermostatic cartridge inside the first chamber; a second securing means to align and secure the flow diverting cartridge inside the second chamber; at least one hot water inlet and one cold water inlet being disposed on one side of said first chamber; said second chamber having at least a first and a second mixed water outlets; a second water passageway connecting the first mixed water outlet of the second chamber to a spout.

19 Claims, 7 Drawing Sheets

UNIBODY THERMOSTATIC RIM OR DECK MOUNT FAUCET ASSEMBLY

FIELD OF THE INVENTION

The present invention primarily relates to a faucet and especially to a unibody faucet with a plurality of elements for a bath tub rim or deck mount.

BACKGROUND OF THE INVENTION

Installing a rim mounted faucet in a small area of a bath tub rim is always challenging for bath tub manufacturers and for professional installers. As the area to install a deck mount faucet is small, faucets with multiple fittings and connections are difficult to install and time consuming. Generally faucets have multiple safety elements, such as a thermostatic cartridge to constantly maintain the pre-set water temperature while in use, and a check valve to prevent the reversal of contaminated water flow and a multi-function diverter valve that act as a stop valve. Installing a faucet with mentioned elements in a bath tub rim needs a significant space, therefore such faucets are not used with many bath tub designs.

Therefore, there is a need to have a safety faucet, which can be installed in a small area on a bath tub rim. Such faucets should be easy to install and maintain, such that damaged components can be replaced without any need to demolish the area around the tub.

The present invention aims to provide a unibody safety faucet with unique components that is easy to install and repair, and which increases the life span of the faucet and its parts.

A standard common functioning tub and shower faucet ideally consists of several components such as a thermostatic cartridge to regulate the temperature of the water exiting out of the faucet, a flow diverter cartridge which directs water flow to a spout or a showerhead, several check valves to prevent the reversal of contaminated water back into the water system, and pressure reducing valves to protect flexible hoses that are connected to the faucet. Conventionally, installing such items requires multiple separate components that then have to be connected to one another or requires external installation of faucet assembly that may not appeal aesthetically to a user.

Components such as the thermostatic cartridge and the flow diverting cartridge ideally need to be accessed easily in times when repair is required. Furthermore, the design of conventional flow diverters requires alterations in order to be placed in a single body faucet. The design of conventional flow diverter parts, such as the O-ring grommets, need to be modified in order to be functional on a unibody faucet system. Conventional O-ring grommets of conventional flow diverter cartridges are not able to stay flush to the surface of the cartridges stem. With normal use, as the flow diverter cartridge turns, the O-ring grommet can collapse and cause miss functioning of the flow diverter cartridge and also cause the O-ring grommet to enter the waterways ports. This can often cause damage to the diverting cartridge and the entire faucet assembly itself. Therefore, a new O-ring grommet design and flow diverter cartridge is needed to prevent their damage with continuous use.

SUMMARY OF THE INVENTION

A unibody safety faucet for bath tubs and decks with small rims or area comprising of a first chamber designed to receive a thermostatic cartridge, said first chamber having a hot and a cold water inlet ports and a mixed water outlet port; a second chamber designed to receive a flow diverting cartridge; said second chamber having a mixed water inlet port, a first outlet port to deliver water to a spout, and a second outlet port to deliver water to a showerhead; a main waterway connecting the mixed water outlet port of the first chamber to the mixed water inlet port of the second chamber; and a faucet waterway connecting the first outlet port of the second chamber to a spout outlet port, said faucet waterway being parallel to said main waterway and said spout outlet port being located in between said first and second chambers, wherein location of said faucet waterway and said main waterway allowing for placement of said safety faucet in small area bath tub rims and decks.

It is a primary object of the present invention to provide a compact unibody safety faucet that is installed on a bath tub rim or deck mount. The unibody design of the present invention having inlet ports for supplying hot and cold water to the interior of the safety faucet and further having outlet ports for spout attachment and showerhead attachment. The compact unibody design allows the present invention to be installed on small bath tub rims or deck mounts.

The second objective of the present invention is to provide a faucet which embedded several safety features in its unibody design. The present invention has check valves installed in the body to preclude the reversal of the water flow of contaminated water to enter the potable water system. One check valve is installed in the hot water inlet port and second check valve in the cold water inlet port, said check valves preclude the reversal of the water flow and thereby prevent contaminated water from entering the potable water system. Additionally, the present invention contains a combined pressure reducing valve and check valve that is connected to a showerhead flexible hose outlet. Thus the present invention is capable of protecting existing plumbing fixtures of a housing unit and also regulating water flow.

A third objective of the present invention is to provide a safety faucet which has a thermostatic cartridge installed in its housing to constantly maintain a pre-set water temperature while in use. Therefore the thermostatic cartridge constantly maintains the pre-set water temperature, or instantly shuts off the water flow in case of fluctuations in water temperature.

A fourth objective of the present invention is to make installation and repair of the safety faucet easier. The time taken for installation of the present invention is estimated to be 75% less than that of conventional faucet assemblies that are currently available in the market. By saving time during the assembly and installation, the present invention will significantly reduce installation cost. The present invention consists of a single unibody design and, as such, it can be easily installed as a single unit. The body of the present invention contains all of the elements required for operation and connection to a hot and a cold water piping, an outlet for a spout, and an outlet for a showerhead. Thus only installation of the present invention is required for those connections without requiring any additional elements.

It is the fifth objective of the present invention to provide a unique flow diverter cartridge which prevents slipping of the grommet during the operation and an easier installation when compared to conventional flow diverter cartridges. The new grommet comprises of two wings, which are axially aligned and fit in an especially designed cut-outs around the open and blind ports of the flow diverter cartridge. The cut-outs are sized to fit the two wings. The unique attachment of the newly designed grommet to the newly designed flow diverter cartridge is more secure than the conventional O-ring. The new grommet design prevents them from slipping off the flow diverting cartridge. The new design has two grommets on both ports one in the open port and one on the blind port, this will insure that the flow diverting cartridge is aligned properly when inserted in the housing of the present invention.

Furthermore, the present unibody safety faucet allows easy access to both the thermostatic and flow diverting cartridges. The chambers housing the cartridges are fully accessible from the outside once the device is installed. Thus, replacement of a cartridge can be performed without the removal of the entire body of the present invention.

Other objects, features, and advantages of the present invention will be readily appreciated from the following description. The description makes reference to the accompanying drawings, which are provided for illustration of the preferred embodiment. However, such embodiments do not represent the full scope of the invention.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

DETAILED DESCRIPTION OF THE DRAWINGS

Figure 1:
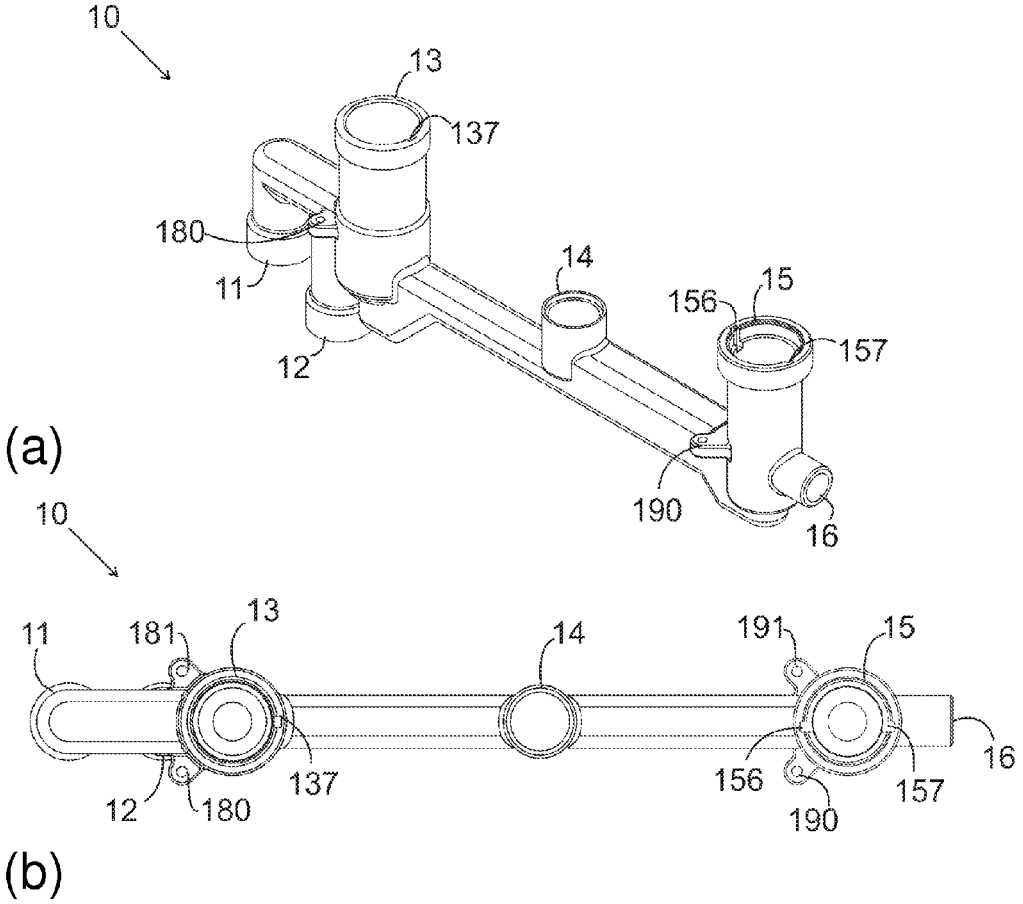
FIG. 1 shows multiple views of the present invention.
Figure 2:
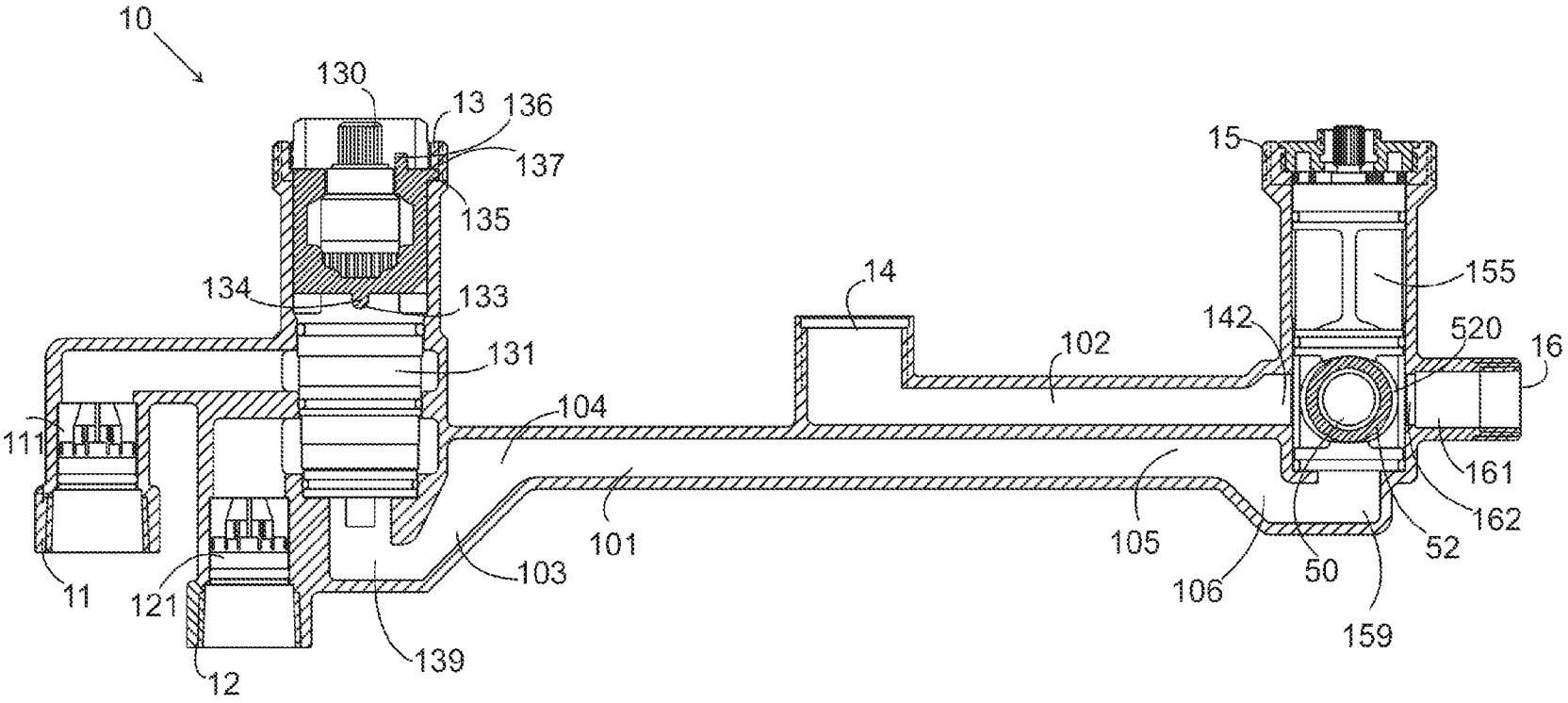
FIG. 2 shows a cross-sectional view of the present invention.

In FIGS. 1-2 is illustrated a unibody faucet for installation in a bath tub rim or deck mount. FIG. 1*a* is an isometric view, FIG. 1*b* is an overhead view and FIG. 2 is a cross-sectional of the unibody 10 of the present invention. The present faucet has a unibody 10 to be installed on bath tubs with small rims or deck with small area. The unibody 10 comprises of a first chamber 13 designed to receive a thermostatic cartridge 130. The first chamber 13 having hot and cold water inlet ports 11-12 and a mixed water outlet port 139. The unibody 10 further having a second chamber 15 designed to receive a flow diverting cartridge 155. Said second chamber 15 having a mixed water inlet port 159, a first outlet port 142 to deliver water to a spout, and a second outlet port 162 to deliver water to a showerhead.

Again referring to FIG. 2, the unibody 10 further having a main waterway 101 connecting the mixed water outlet port 139 of the first chamber 13 to the mixed water inlet port 159 of the second chamber 15. A faucet waterway 102 connecting the first outlet port 142 of the second chamber 15 to a spout outlet port 14. Said faucet waterway 102 being parallel to said main waterway 101. Also, said spout outlet port 14 being located in between said first and second chambers 13-15. The present design of said faucet waterway 102 and said main waterway 101 allows that the safety faucet can be installed in small bath tub rims or decks area.

Again referring to FIG. 2, the first chamber 13 and the second chamber 15 are located on the opposite sides of the unibody 10 and are equidistant from faucet outlet port 14. Faucet outlet port 14 is located generally in the center of the unibody 10 such that faucet waterway 102 extends to approximately half the length of main waterway 101. The first chamber 13 and second chamber 15 are sized to house a thermostatic cartridge 130 and flow diverter cartridge 155 along with mechanical adaptations attachment of levers located outside of the body of the present invention.

The construction and design of the compact unibody 10 allow it to be easily installed in conventional tub or deck with the preexisting plumbing fixtures. The first chamber 13 serves to receive a thermostatic cartridge 130 which will regulate the temperature for both the spout and the shower. The second chamber 15 serves to receive a flow diverting cartridge 155 capable of directing water to the spout and the shower without needing to readjust the temperature for each water output additionally the cartridge 155 will act to stop water flow. The overall compact design created by bringing two waterways 101 and 102 in contact with each other and only separated by a wall allows taking up less space such that it can be installed on small bath tub rim deck.

The overall design of the structure of the unibody 10 allows for compact dimensions. For example, the length of the unibody 10 between said hot and cold water inlets 11-12 to the shower outlet port 16 can range from 380 mm to 420 mm. The height of the unibody 10 between the top of the first chamber and the bottom of the hot and cold water 11-12 inlets can range from 80 mm to 120 mm.

Again as shown in FIG. 1, two pairs of ears 190-191 and 180-181 extending away from the unibody 10 located near the chambers 13 and 15 are used to secure the unibody 10 to a bath tub or deck rim by four screws (not shown). By fastening four screws from the bottom, the unibody 10 is fixed to the bath tub.

Figure 3:
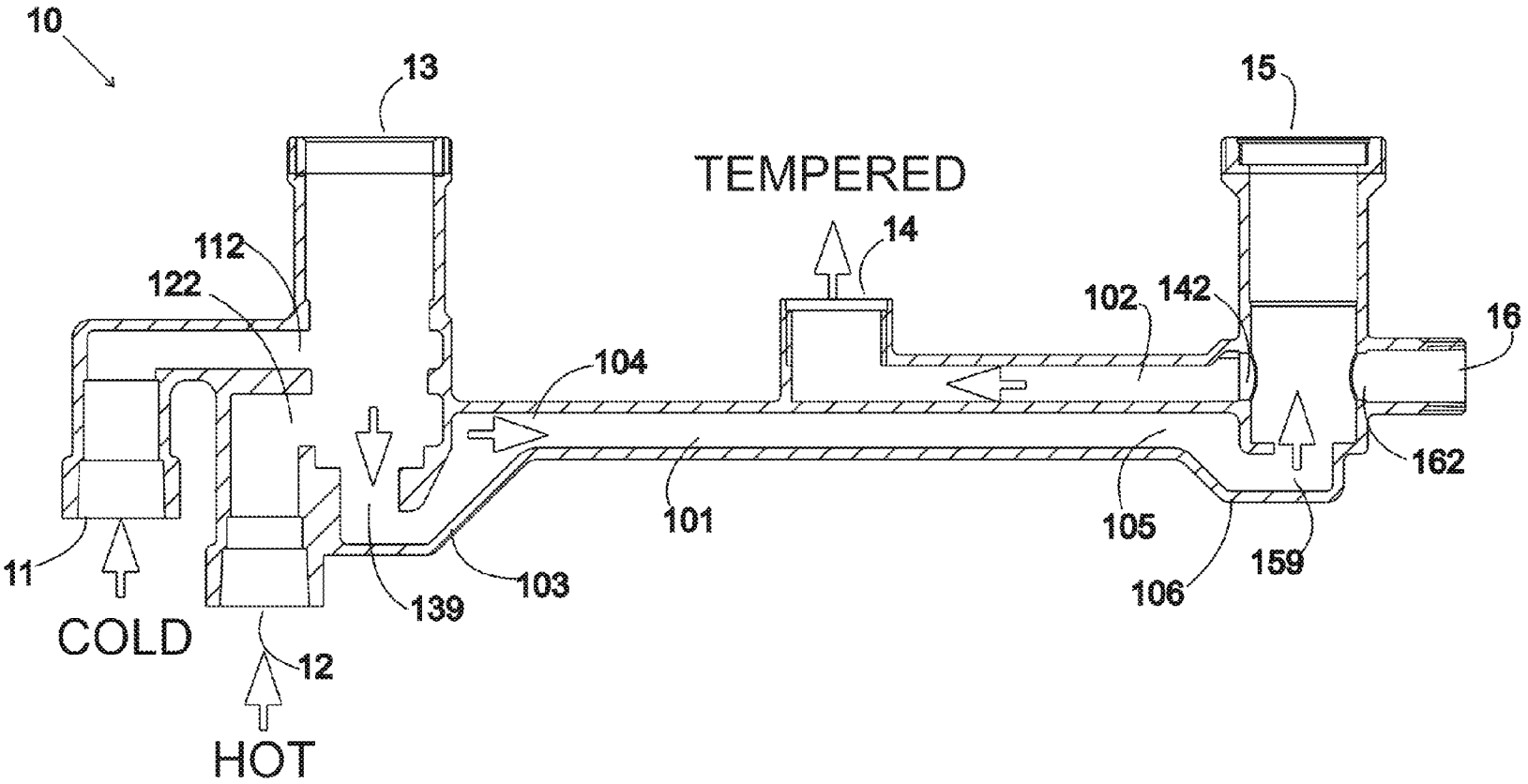
FIG. 3 shows direction of water flow in the ideal embodiment of the present invention.

The internal water flow path of the present invention is illustrated referring to FIGS. 2-3. Cold water is supplied to the unibody 10 through the cold inlet port 11 and hot water is supplied through the hot inlet port 12. The water from the inlet ports 11-12 enters the first chamber 13 from its ends 112-122 to a housing 13 for a thermostatic cartridge 131 which regulates the ratio of the hot and the cold water flow. A user may adjust the ratio of the hot and cold water by adjusting the thermostatic cartridge 131.

As shown in FIGS. 2-3, cold and hot water which is mixed by a thermostatic cartridge housed inside the first chamber 13 will exit through the cartridge at the bottom 139 of the first chamber 13. An angled waterway 103 connects bottom of the first chamber 139 to main waterway 101 at main waterway's left end 104. Main waterway 101 is straight and connects to a second bend 106 at its right end 105. The second bend 106 is connected to the second chamber bottom 159. The second chamber 15 contains three openings, one at the bottom 159 at which water enters, and two openings 142 and 162 located on opposing side walls of the second chamber 15. Faucet opening 142 connects the second chamber 15 to the faucet waterway 102. The faucet waterway 102 connects at one end to a spout outlet 14. Showerhead opening 162 connects the second chamber 15 to showerhead outlet 16.

Figure 4:
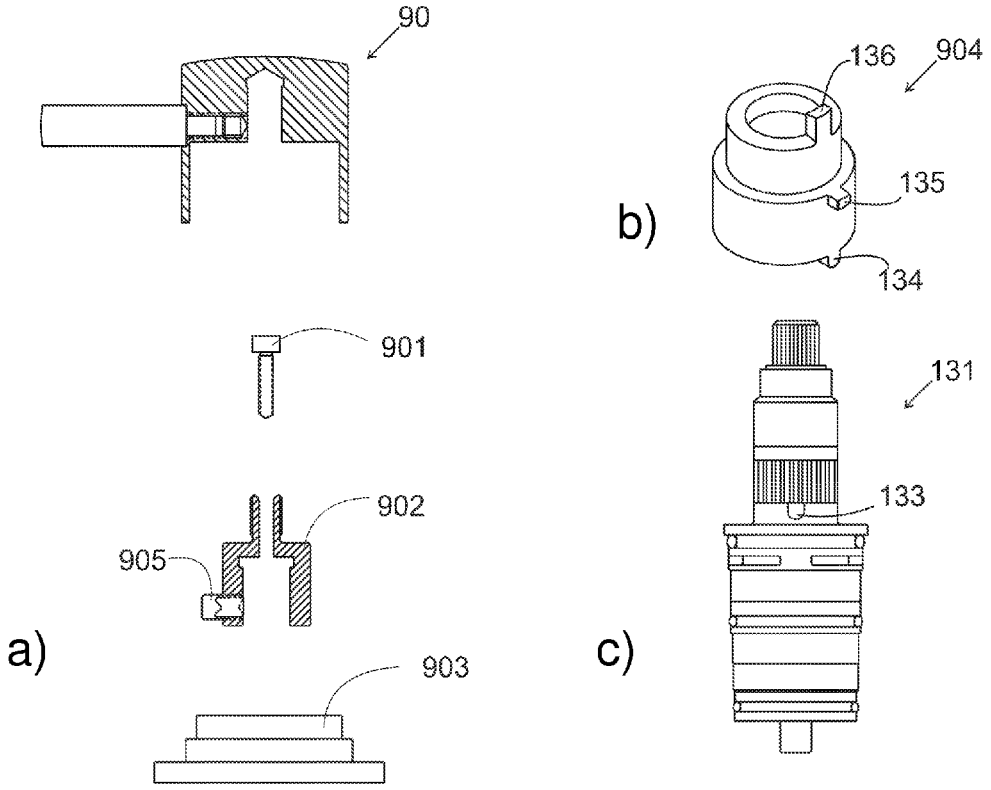
FIG. 4 shows the handle assembly, the thermostatic cartridge high limit sleeve, spline adapter and trim escutcheon.
Figure 6:
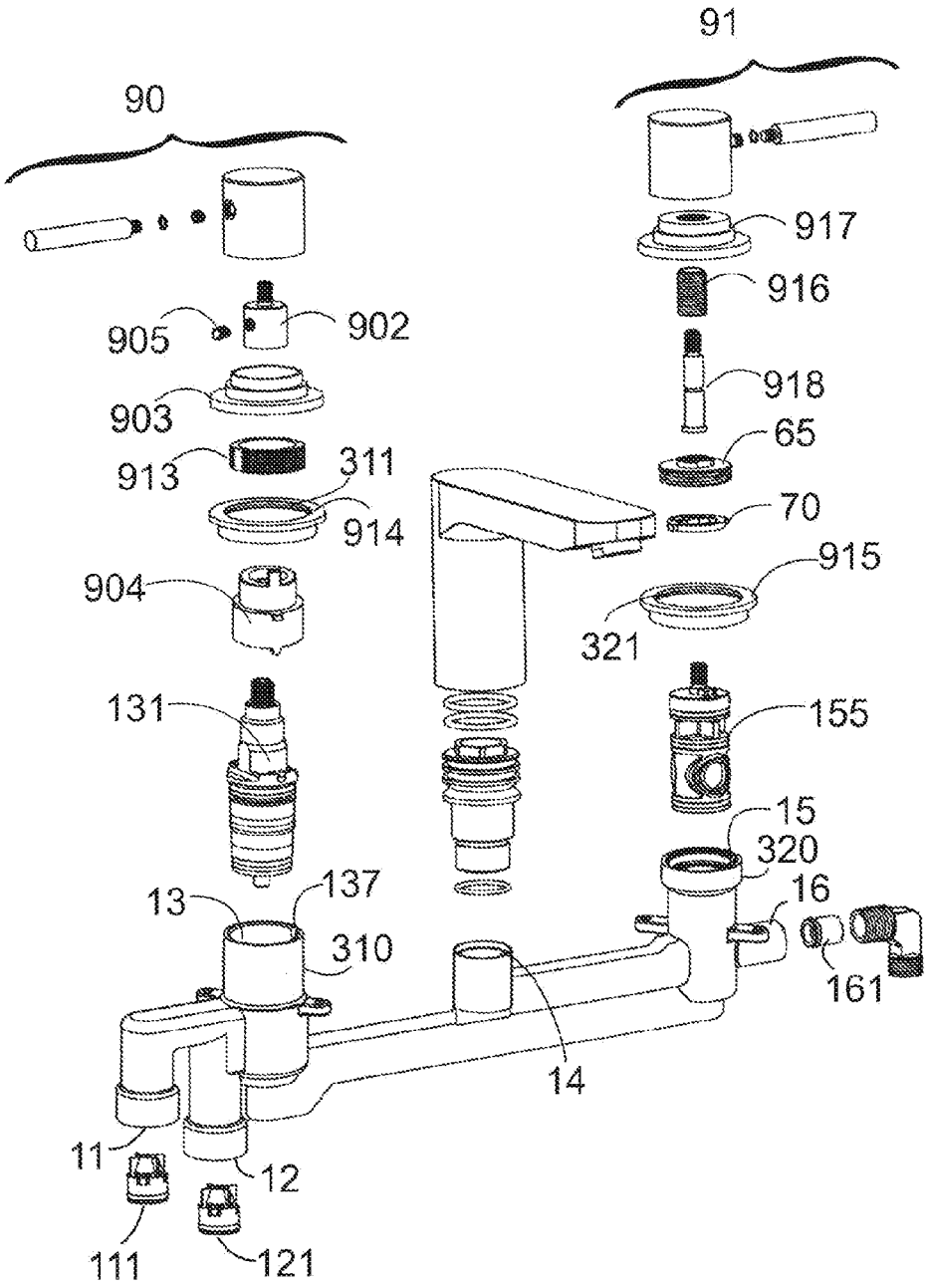
FIG. 6 shows an exploded view of the present invention and all of its parts.

As shown in FIGS. 4 and 6, the thermostatic cartridge 131 is inserted into the first chamber 13. A handle 90 facilitates rotation of the thermostatic cartridge 131 inside the first chamber 13. For aligning the thermostatic cartridge 131 inside the first chamber 13, a high limit sleeve 904 as shown in FIG. 4*b* is placed on top of the thermostatic cartridge 131 when inside the first chamber 13. The high limit sleeve 904 has two securing means to align the thermostatic cartridge 131 inside the first chamber 13. The first securing means is a tab 134 sized and shaped to engage with a cut-out 133 in the thermostatic cartridge 131 designed in the bottom of the high limit sleeve 904. The second securing means is a second tab 135 designed to extend outwardly in the middle of the high limit sleeve 904; the second tab 135 being placed in a cut-out 137 designed in the outer body of the first chamber 13.

As shown in FIGS. 4 and 6, a third high limit post 136 designed at the top of the high limit sleeve 904 being engaged with a temperature control screw 905 in a spline adaptor 902. The screw 905 is responsible for fastening spline adapter 902 on the thermostatic cartridge spline 130 as well to adjust the temperature of the water coming out of the cartridge 131. The handle 90 facilitates rotation of the thermostatic spline 130 of cartridge 131 inside the first chamber 13 by the spline adaptor 902. The spline adaptor is secured on spline 130 on top of the thermostatic cartridge 131.

Figure 7:
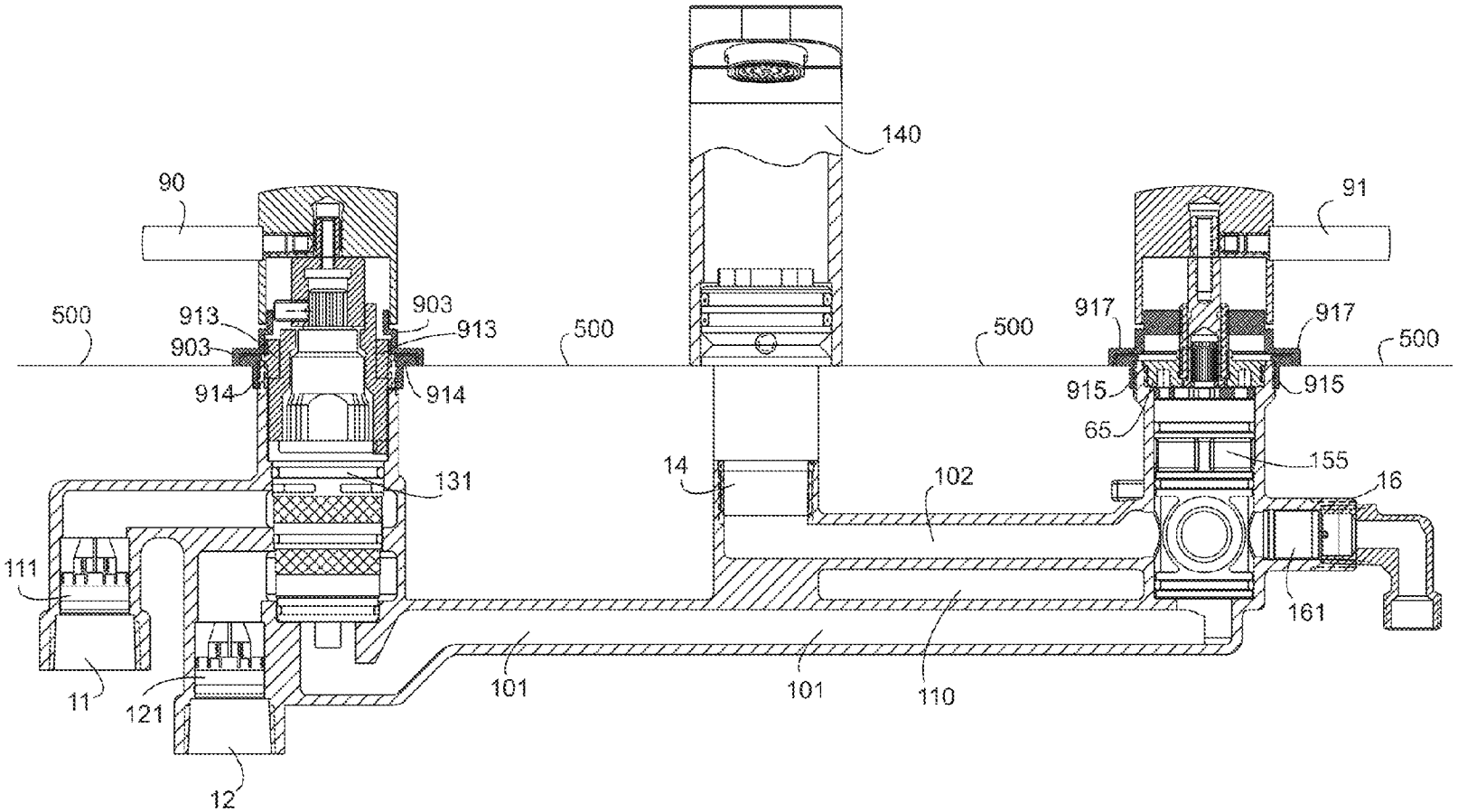
FIG. 7 shows an alternative embodiment of the unibody design of the present invention.

As shown in FIGS. 6-7, a body nut 913 is another securing means for aligning the thermostatic cartridge 131 inside the first chamber 13. The internal diameter of the body nut 913 is sized to the upper part of the high limit sleeve 904 and is placed on the top of the second tab 135. The external wall of the body nut 913 is threaded such that it is engaged by the thread of the internal wall of the first chamber 13.

Again referring to FIGS. 6-7, a body hub 914 is engaged with the first chamber 13 to secure the first chamber 13. The body hub 914 has threads 311 in its internal wall and is engaged with the same sized threads 310 designed in the outer wall of the first chamber 13. A decorative plate, or escutcheon 903 surrounds the installed components to cover them and to conceal the internal parts from view. The escutcheon 903 has threads in its internal wall and is engaged by the external wall of the body nut 913.

Figure 5:
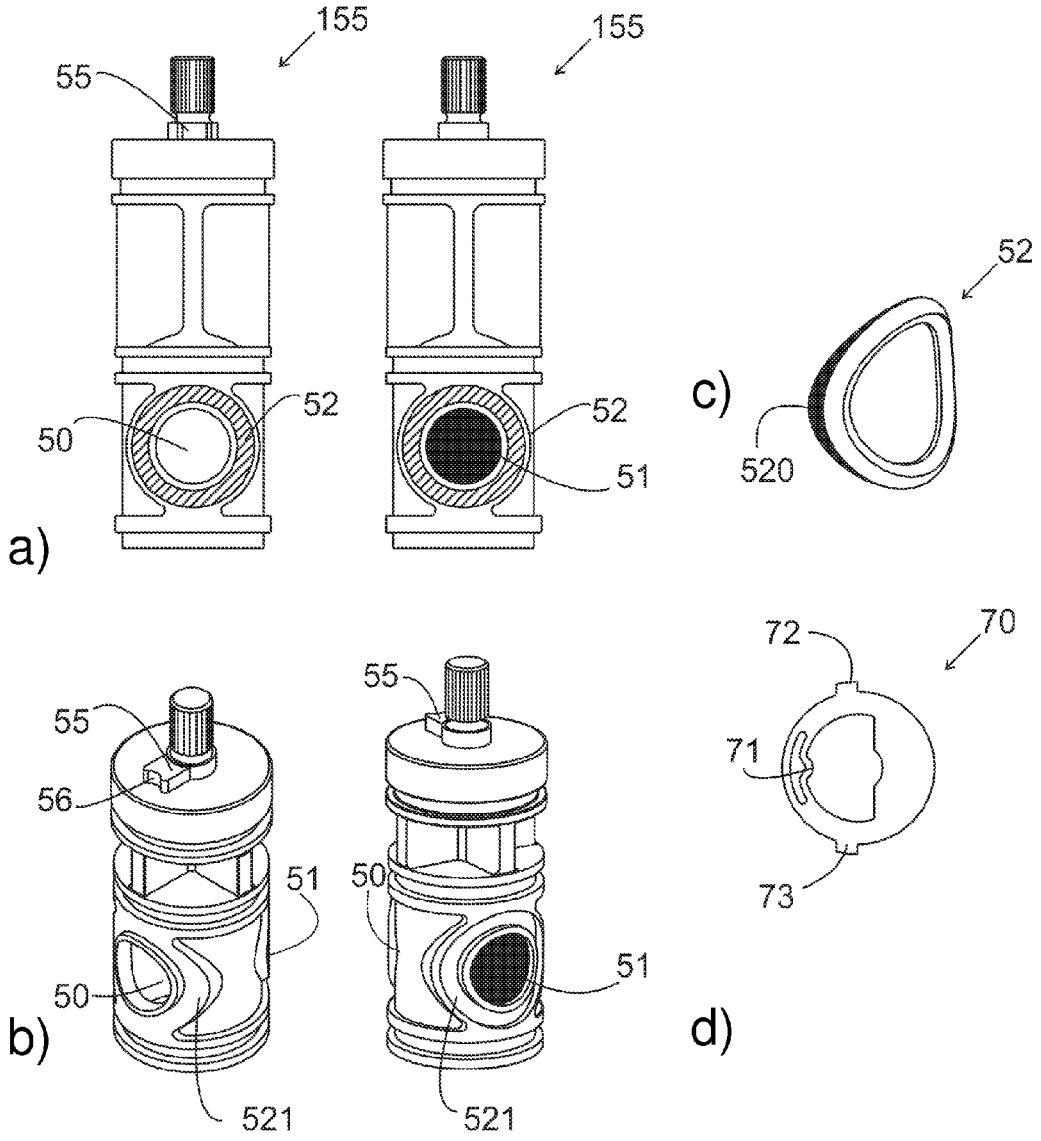
FIG. 5 shows the specially designed flow diverting cartridge, grommet and detent stopper washer.

Diverting cartridge 155 is housed in the second chamber 15 and has a novel design as shown in FIG. 5 (*a-b*). FIG. 6-7 show the installation components for the diverting cartridge 155 and the way that each component is installed in the present invention. As shown in FIG. 5 (*a-b*), open port 50 and blind port 51 are located on the front and the back of the diverting cartridge 155, respectively. Open port 50 is shown in the left panel of FIG. 5*a* and blind port 51 is shown in the right panel.

As shown in FIGS. 5 and 6, the diverting cartridge 155 is inserted into the second chamber 15. A handle 91 facilitates rotation of the diverting cartridge 155 inside the second chamber 15. For aligning the diverting cartridge 155 inside the second chamber 15, a pair of O-ring grommets 52 is placed on each side of the diverting cartridge 155 to keep it centered when it is installed in the second chamber 15 as well grommet 52 will act as positive stop when the diverting cartridge is in the off position.

The grommet 52 will be axially aligned in order to keep the diverting cartridge 155 centered in the second chamber 15. An indentation 521 is designed around the opening and closing ports 50-51, the indentation is shaped to receive the grommet 52. Grommet 52 has two arc shaped wings 520 extending outwardly of the grommet with the first arc shaped wing located at 3 o'clock position and the second arc shaped wing located at the 9 o'clock position. The arc shaped wings 520 are designed to provide a snug fit with the aid of specially designed indentations 521 in the body of the diverting cartridge 155. The arc shaped wings 520 fit snugly in indentations 521 such that O-ring grommet 52 is in complete contact with the inner surface of the second chamber 15.

The shape of the grommet 52 is specifically designed to adhere closely to the diverting cartridge 155. The specific shape of the grommet 52 allows it to fit a curved area. The unique design of grommet 52 prevents it from collapsing inside the ports 142 or 162 of chamber 15 when diverting cartridge 155 is turned to direct the water flow by a user.

As shown in FIGS. 5-7, turning of the diverting cartridge 155 is performed by a detent tooth 55 integrally designed and formed at the top of the diverting cartridge. When turning the diverting cartridge 155, the tooth 55 rotates at the same time, a stationary spring detent washer 70 is designed to navigate and act as a detent for the tooth 55. The spring detent washer 70 comprising of two ears 72 and 73 extend outwardly from the side of the spring detent washer 70 and an indentation 71 placed in the center at the internal surrounding projected inwardly in respect to the ears 72-73. Two ears 72-73 are sized to fit in the cut outs 156 and 157 at the internal wall of the second chamber 15 and the indentation 71 designed to fit detent tooth curve 56 of tooth 55 of the diverting cartridge 155. When the indentation 71 is engaged with the curve 56 it signals that the diverting cartridge 155 is in the stop position.

For securing the diverting cartridge 155 inside the second chamber 15, a body hub 915 is used. The body hub 915 has threads 321 in its internal wall which are engaged with the same sized threads 320 designed in the outer wall of the second chamber 15.

As shown in FIG. 6-7, the handle 91 is connected to the diverting cartridge 155 with a handle spline 918 and a spline 918 is held in place by sleeve 916 on trim body nut 65. The trim body nut 65 has treads in its surrounding wall sized which are sized to be engaged with the treads of the internal wall of the body hub 915. The trim body nut 65 keeps the spring detent washer 70 in a proper place. The sleeve 916 and spline extension 918 are engaged with spline 156 of diverting cartridge 155. A decorative trim escutcheon 917 is installed to complete a finished look of the faucet.

Water directed toward the showerhead outlet 16 passes through a combined pressure reducing valve and check valve 161. A pressure valve 161 is necessary to reduce average water supply pressure of 75 psi to 3 psi. The combined pressure reducing valve and check valve 161 protects the shower hose from bursting or being damaged in case of high water pressure also to reduce and maintain the water flow at a rate of 2.5 GPM as is required by building codes The combined pressure reducing valve and check valve 161 is inserted at the showerhead outlet 16 therefore the excessive pressure will stay within the body.

An alternative embodiment of the unibody of present invention is shown in FIG. 7. The second embodiment of the present invention is still comprised of a compact unibody design as in the previous embodiment; however, the faucet waterway 102 is not in contact with the main body waterway 101. Instead, a gap 110 is present between the faucet waterway 102 and the main body waterway 101. This purpose of the alternative embodiment is to alleviate or facilitate the process in case of adverse manufacturing difficulties by having two closely connecting waterways 101-102.

As shown in FIG. 7, the unibody of the present invention with all components which installed on a bath tub rim or deck area is behind a wall 500. The user only sees two handles 90-91 and a spout 140.

The forgoing is considered as illustrative only of the principles of the invention. Further, since numerous modification and changes will readily occur to those skilled in the art, it is not desired to limit the invention to the exact construction an operation shown and described, and accordingly, all suitable modifications and equivalents may be resorted to, filling within the scope of the invention.

With respect to the above description, it is to be realized that the optimum relationship for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by present invention.

What is claimed is:

1. A deck or bath tub mounted unibody safety faucet comprising:

a. a unibody housing comprising a first chamber and a second chamber being at two ends of a longitudinal first water passageway, said chambers oriented perpendicular to said first water passageway;

b. said first chamber receiving a thermostatic cartridge and the second chamber receiving a diverting flow cartridge;

a. a first securing means to align and secure said thermostatic cartridge inside the first chamber;

b. a second securing means to align and secure said flow diverting cartridge inside said second chamber;

c. at least one hot water inlet and one cold water inlet being predisposed on one side of said first chamber;

d. said second chamber having at least a first and a second mixed water outlets;

e. a second water passageway connecting the first mixed water outlet of the second chamber to a spout, said first and second water passageways being substantially parallel;

f. said second mixed water outlet being in fluid communication with a shower head port;

whereby location and design of said first water passageway and said second water passageway allowing for installing of said unibody safety faucet in small area of bath tub rims and decks.

2. The deck or bath tub mounted unibody safety faucet of claim 1, wherein said first securing means comprising of a. a high limit sleeve having a top and bottom, a plurality of tabs to be engaged with a plurality of cut-outs sized and shaped to receive said tabs in said thermostatic cartridge and said first chamber; and b. a body nut having an internal diameter and an external diameter, said internal diameter being sized to said top of said high limit sleeve and said external diameter being threaded to be engaged by a thread of an internal wall of said first chamber.

3. The deck or bath tub mounted unibody safety faucet of claim 2, wherein said high limit sleeve further having a projected tooth designed on said top of said high limit sleeve to be engaged with a temperature control post to adjust the temperature of the hot and cold water.

4. The deck or bath tub mounted unibody safety faucet of claim 1, wherein said second securing means comprising of a. a pair of O-ring grommets being placed on a pair of indentations which are designed around an opening port and a blind port on said flow diverting cartridge; and b. a body hub having threads in an internal wall being engaged with threads designed in an outer wall of said flow diverting cartridge.

5. The deck or bath tub mounted unibody safety faucet of claim 4, wherein said grommet having two arc shaped wings extending outwardly of a grommet body with the first arc shaped wing located at 3 o'clock position and the second arc shaped wing located at the 9 o'clock position.

6. The deck or bath tub mounted unibody safety faucet of claim 1, wherein said inlets extending perpendicular to the longitudinal axis of the first water passageway.

7. The deck or bath tub mounted unibody safety faucet of claim 1, wherein said second mixed water outlets further having a check valve.

8. The deck or bath tub mounted unibody safety faucet of claim 1, wherein the length of said unibody safety faucet between said hot and cold water inlets to said shower head port ranging from 380 mm to 420 mm.

9. The deck or bath tub mounted unibody safety faucet of claim 1, wherein the height of said unibody safety faucet between a top of said first chamber and a bottom of said water inlets ranging from 80 mm to 120 mm.

10. The deck or bath tub mounted unibody safety faucet of claim 1, wherein said second water passageway extending approximately half the distance of said first water passageway.

11. The deck or bath tub mounted unibody safety faucet of claim 1, wherein said spout outlet port being located approximately at centre of distance between said first chamber and said second chamber.

12. The deck or bath tub mounted unibody safety faucet of claim 1, wherein said hot and cold inlet ports being sized to fit and engage a standard hot and cold water pipe connection respectively.

13. The deck or bath tub mounted unibody safety faucet of claim 1, wherein said showerhead outlet port being sized to fit and engage a standard showerhead pipe connection.

14. The deck or bath tub mounted unibody safety faucet of claim 1, further having a pair of check valves being placed at said hot and cold water inlet ports to prevent the reversal of the water flow.

15. The flow diverting cartridge of claim 14, being comprised of:

a. diverter cartridge body said body having an open port and a blind port located at opposite ends of said diverter cartridge body;

b. a pair of specifically shaped indentations located on each side of said open and said blind ports;

c. a grommet with a center circular opening having a pair of axially aligned wings extending outwardly;

d. a pair of specifically shaped indentations for housing said axially aligned wings from said grommet being located on each side of said open port and said blind port, said indentations are sized to receive said axially aligned wings of said grommet;

e. a tooth located on top of said diverting cartridge body; and f. a stationary spring detent washer placed on top of said diverting cartridge holds in place by the trim nut is engaged with said tooth of said diverting cartridge body.

16. The deck or bath tub mounted unibody safety faucet of claim 1, wherein said thermostatic cartridge being placed at said first chamber to regulate the ratio of mixing of said hot water and said cold water.

17. The deck or bath tub mounted unibody safety faucet of claim 1, wherein said flow diverting cartridge being placed at said second chamber to divert mixed water to said shower head port or said spout.

18. The deck or bath tub mounted unibody safety faucet of claim 1, further having a combination of check valve and pressure reducer valve at said shower outlet port to regulate the water flow to said showerhead.

19. The deck or bath tub mounted unibody safety faucet of claim 1, wherein said main waterway and said faucet waterway being parallel and being separated by a gap.

* * * * *